United States Patent [19]

Marks

[11] Patent Number: 4,909,542

[45] Date of Patent: Mar. 20, 1990

[54] CREATURE BOOK

[76] Inventor: Cara Marks, 388 Konridge Rd., Lawrence, N.Y. 11559

[21] Appl. No.: 203,468

[22] Filed: Jun. 7, 1988

[51] Int. Cl.[4] ..... B42D 1/00

[52] U.S. Cl. ..... 281/15.1; 281/21.1

[58] Field of Search ..... 281/15 R, 18, 21, 24, 281/31, 35; 412/3, 17

[56] References Cited

U.S. PATENT DOCUMENTS

| | | |
|---|---|---|
| 3,257,128 | 6/1966 | Schneider . |
| 3,715,816 | 2/1973 | White . |
| 3,811,220 | 5/1974 | Glass et al. . |
| 4,063,369 | 12/1977 | Hart . |
| 4,280,241 | 7/1981 | Pfaff . |
| 4,509,280 | 4/1985 | Smith . |
| 4,630,843 | 12/1986 | Willat . |

*Primary Examiner*—Paul A. Bell

*Attorney, Agent, or Firm*—Fay, Sharpe, Beall, Fagan, Minnich & McKee

[57] ABSTRACT

A creature book includes a back cover and a front cover. The back cover has inner and outer superposed panels of material which are fastened to each other and which have coextensive peripheries. The front cover also has inner and outer superposed panels of material which are fastened to each other and have coextensive peripheries. A layer of soft material is held between the inner and outer panels of the front cover. A creature representation is provided on the front cover outer panel. The creature representation includes a plurality of limbs with at least two of the limbs extending outwardly away from the coextensive peripheries of the inner and outer panels of the front cover. Indicia are provided on at least one of the inner and outer superposed panels of the front and back covers. A binding is disposed along an edge of each of the front and back covers for securing them together.

19 Claims, 8 Drawing Sheets

CREATURE BOOK

BACKGROUND OF THE INVENTION

This invention generally pertains to books. More specifically, the present invention relates to a creature book, that is, a book having a cover with a creature representation thereon.

The invention is particularly applicable to a child's picture book having on its front cover a three dimensional creature representation. The book is soft and cuddly, free of any sharp edges, and well adapted to make a child familiar with books at an early age. The book is both a learning device and a cuddly pillow-like toy for very young children. Although the book invention will be described as being adapted for use by very young children, it is evident that the book could be suitably designed for use with older children or even grown-ups, if desired.

It is known in the art to provide soft books for children. That is, books having relatively few leaves that are made of a soft material are known. Also, soft books in which each of the leaves is provided with a padding material interposed between the panels of the leaf, are also known to the art.

However, none of the prior art soft children's books is provided with a three dimensional creature representation thereon or with various other features which would enhance enjoyment of the book by children or the use of the book in various games, or to tell stories.

Accordingly, it has been considered desirable to develop a new and improved book which would overcome the foregoing difficulties and others and meet the above-stated needs while providing better and more advantageous overall results.

BRIEF SUMMARY OF THE INVENTION

In accordance with the present invention, a new and improved creature book is provided.

More particularly in accordance with the invention, the creature book comprises a back cover comprising inner and outer superposed panels of material which are fastened to each other and have coextensive peripheries. The book also comprises a front cover comprising inner and outer superposed panels of material which are fastened to each other and have coextensive peripheries. A layer of a soft material is held between the inner and outer panels of the front cover. A creature representation is provided on the front cover outer panel. The creature representation includes a plurality of limbs wherein at least two of the limbs extend outwardly away from the coextensive peripheries of the inner and outer panels. Indicia are provided on at least one of the inner and outer superposed panels of the front and back covers. A binding means is disposed along one edge of each of the front and back covers for securing them together.

According to another aspect of the invention, the creature book further comprises at least one leaf disposed between the front and back covers. The at least one leaf is secured along an edge to the front and back covers by the binding means.

According to still another aspect of the invention, the creature book further comprises a means for releasably securing the front and back covers along an edge opposed to the edge along which the binding means is disposed. Preferably, the means for releasably securing comprises a hook and loop fastener device including cooperating sections provided on the front and back covers.

According to a further aspect of the invention, the front cover further comprises at least one pocket means provided on the outer panel for holding an object.

According to a still further aspect of the invention, the creature book further comprises a smaller second book including at least two pages. The second book is secured to the front cover of the creature book.

According to a yet further aspect of the invention, the front cover further comprises a patch of hook and loop material and a relatively small second creature is provided which can be selectively secured to the book front cover by a corresponding patch of hook and loop material provided on the second creature.

According to a yet further aspect of the invention, the creature book further comprises a relatively small creature having limbs and a connecting strap secured at a first end to a limb of the relatively small creature, and at a second end, to a limb of the creature representation on the book front cover.

According to still yet a further aspect of the invention, the creature book further comprises a first body strap secured at each of its ends to one of the front and back covers and a second creature including a plurality of limbs. A second body strap is secured at each of its ends to the second creature. A connecting strap is secured at a first end to a limb of the creature representation on the front cover and is secured at a second end to a limb of the second creature.

In accordance with a yet further aspect of the invention, the creature book rear cover further comprises a layer of soft material which is held between the inner and outer panels. A creature representation is provided on the outer panel with the creature representation including a plurality of limbs wherein at least two of the limbs extend outwardly from the outer panel of the rear cover.

One advantage of the present invention is the provision of a new and improved soft book which has a creature representation on the front cover thereof.

Another advantage of the present invention is the provision of a book in which the front and back covers can be secured to each other along an edge opposing the binding, when desired.

A further advantage of the present invention is the provision of a soft character book that can be fastened closed so that it can be used as a character to act out a story in the book.

Still another advantage of the present invention is the provision of a book which has a three dimensional creature representation on a front cover thereof, and can, if desired, also have such a representation on the back cover.

Yet another advantage of the present invention is the provision of a book which is provided with at least one pocket for holding additional objects. A strap can also be provided to allow the book to be used as a child's purse.

An additional advantage of the present invention is he provision of a book that has a smaller second book secured to the front cover of the larger book.

A still further advantage of the present invention is the provision of a creature combination including a creature book to which a first body strap is secured and a second creature to which a separate second body strap is secured. A connecting strap is secured between the creature book and the second creature. In this way, the creature book can be secured to one person while the second creature is secured to another person and the two individuals are thereby connected by the connecting strap between them.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred and alternate embodiments of which will be described in detail in this specification and illustrated in the accompanying drawings which form a part hereof and wherein.

DETAILED DESCRIPTION OF THE PREFERRED AND ALTERNATE EMBODIMENTS

Figure 1:
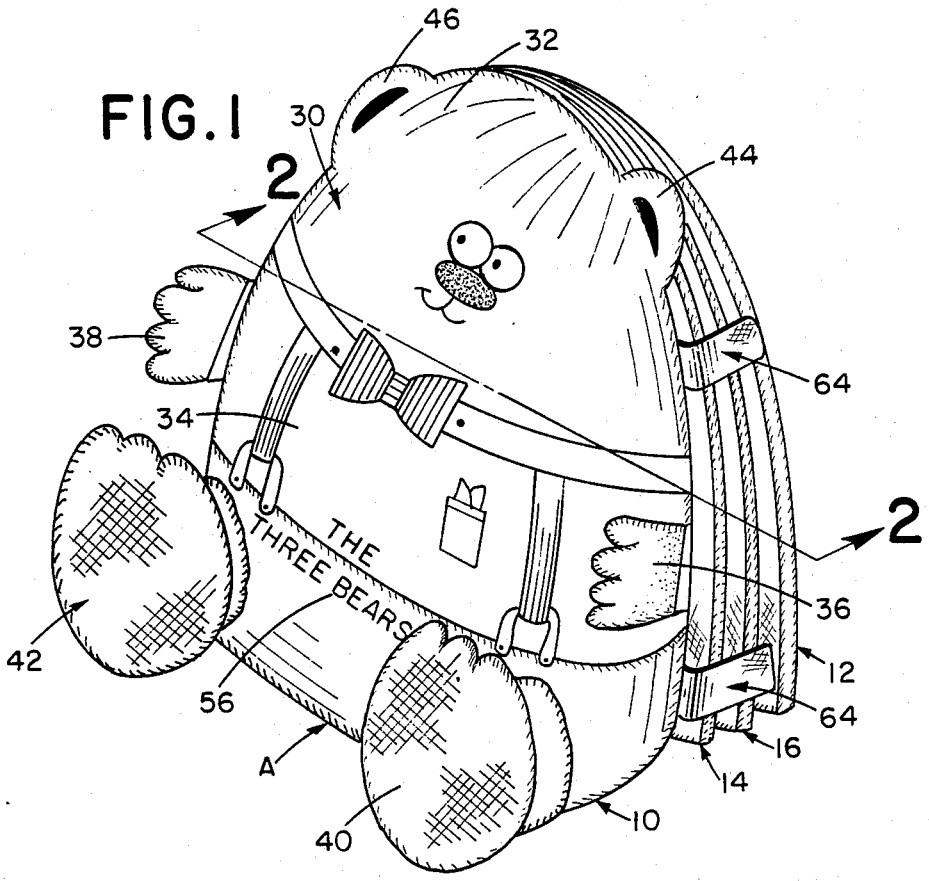
FIG. 1 is a perspective view of a creature book according to a preferred embodiment of the present invention.

Referring now to the drawings, wherein the showings are for purposes of illustrating preferred and alternate embodiments of the invention only and not for purposes of limiting same, FIG. 1 shows the subject new creature book A. While the creature book is primarily designed for and will hereinafter be described in connection with a soft, cuddly type book, especially adapted for use by young children, it will be appreciated that the overall inventive concept involved could be adapted for use in other book environments as well.

Figure 2:
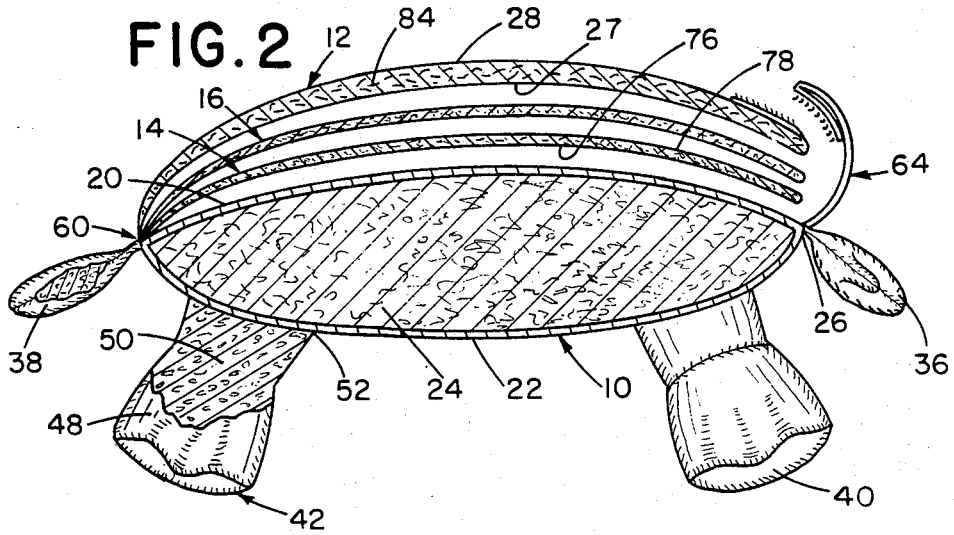
FIG. 2 is a cross sectional view along line 2—2 of the creature book of FIG. 1.

More particularly, the creature book A comprises a front cover 10 and a back cover 12. One or more leaves 14, 16 can be provided between the front and back covers. With reference to now also to FIG. 2, the front cover 10 can include an inner panel 20 and an outer panel 22. A soft material layer 24 can be positioned between the inner and outer panels which have coextensive peripheries as is indicated at 26. The back cover can also have inner and outer panels 27, 28 as shown.

As is shown in FIG. 1, a creature representation 30 is provided on the front cover outer panel 22. The creature representation includes a face portion 32, a torso 34, and a pair of arms 36, 38, a pair of legs 40, 42, and a pair of ears 44, 46. FIGS. 1 and 2 illustrate that the four limbs of the creature extend away from the front cover outer panel 22. More specifically, the two arms 36, 38 extend outwardly from the periphery 26 of the outer panel 22 but generally in the same plane as the outer panel. In contrast, the two legs 40, 42 extend substantially normal to the outer panel 22. Each of the arms and legs is identically made. Therefore, only one of these four limbs will be discussed in detail, it being appreciated that the other limbs are similarly constructed. With reference to leg 42, it is provided with an outer cover 48 enclosing a padding material 50 so as to form a three dimensional body. An attaching zone 52 secures the outer cover 48 to the book front cover outer panel 22.

Written indicia 56 can be provided on the front cover outer panel 22 if desired. The written indicia can be the title of the book.

A binding means 60 is provided along one edge of the front and back panels 10, 12 and the leaves 14, 16 as is best illustrated in FIG. 2. The binding means enables the several pages of the book to be securely connected together so that the book maintains its integrity while still enabling each of the book pages to be viewed. It is noted that the positioning of the pair of legs 40, 42 in a direction substantially normal to the book front cover 10 enables the book to be free standing in an upright orientation. This may be advantageous for some uses.

Figure 3:
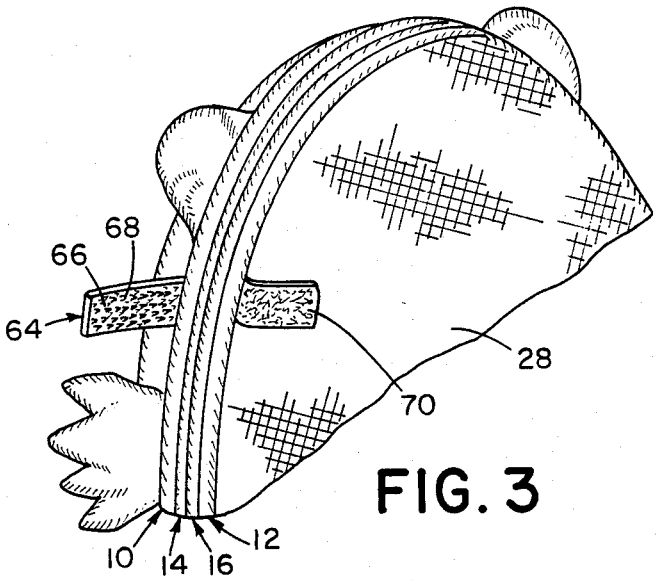
FIG. 3 is a perspective view from the rear of an upper portion of the creature book of FIG. 1 showing the book in a closed position.

A securing means 64, used for holding the book in a closed position when desired, is provided along an edge of the book opposed to the edge along which the binding means 60 is provided. With reference now also to FIG. 3, the securing means can comprise a flap 66 secured to the front cover 10 and having a strip 68 of hook and loop material, such as Velcro brand material, secured thereto. A suitable strip 70 of hook and loop material is secured to the back cover outer panel 28 to cooperate with the hook and loop material strip 68. If desired, two such securing means 64 can be provided in a spaced fashion along the edge opposing the edge on which the binding means is provided, as shown in FIG. 1.

Figure 10:
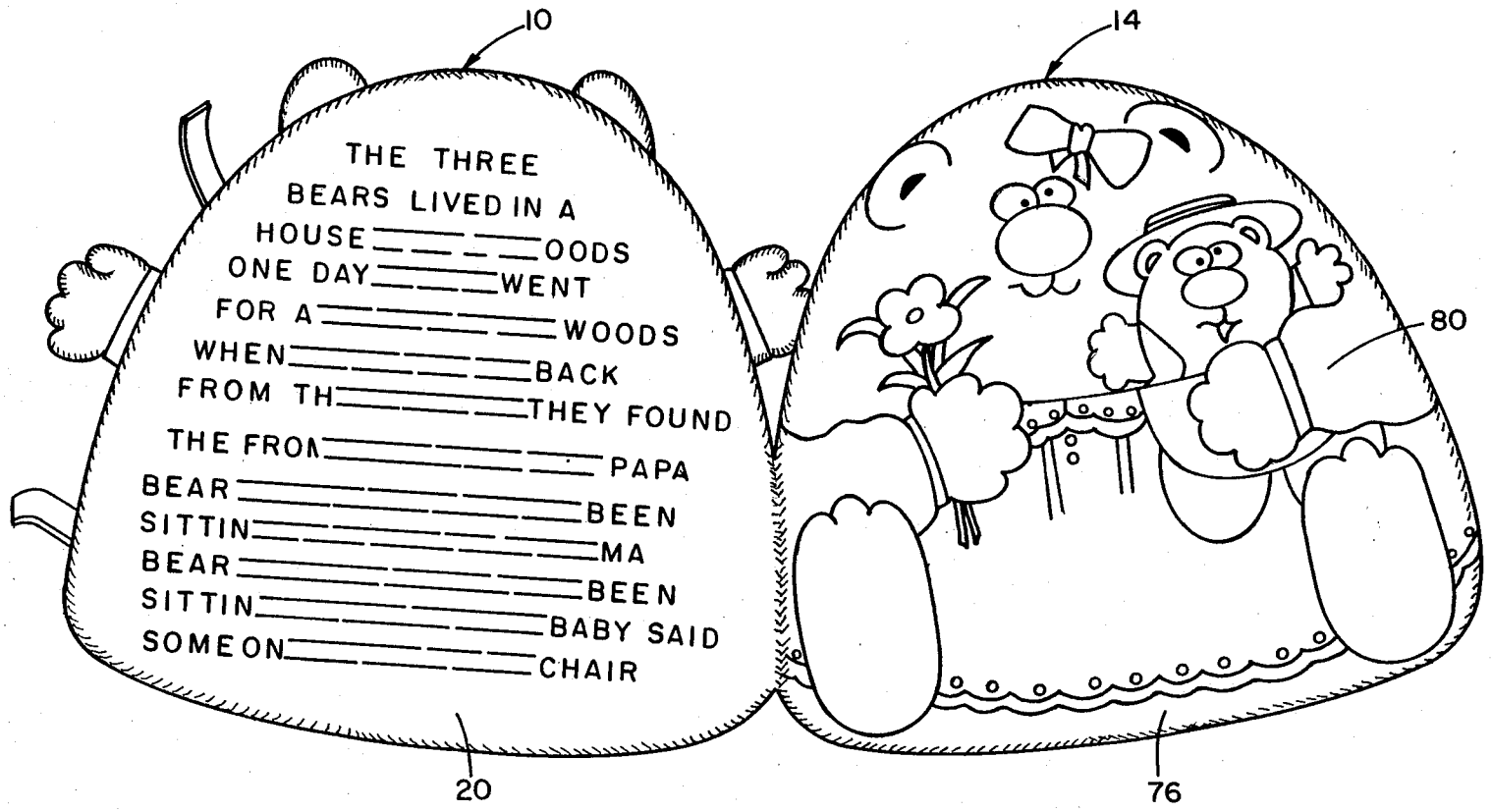

With reference now to FIG. 10, the inner panel 20 of the front cover 10 can be provided with written indicia 74 as is illustrated. The adjoining leaf 14 can similarly be provided with front and back panels 76, 78. A picture 80 may be provided on the leaf front panel 76 if desired to illustrate the story.

Although only the front cover 10 was described as having a pair of superposed panels 20, 22 with a padding material 24 therebetween, it should be recognized that the rear cover 12 can be similarly constructed. More specifically, and with reference again to FIG. 2, the rear cover can comprise the pair of panels 27, 28 having coextensive peripheries with a layer 84 of padding material held therebetween.

Figure 4:
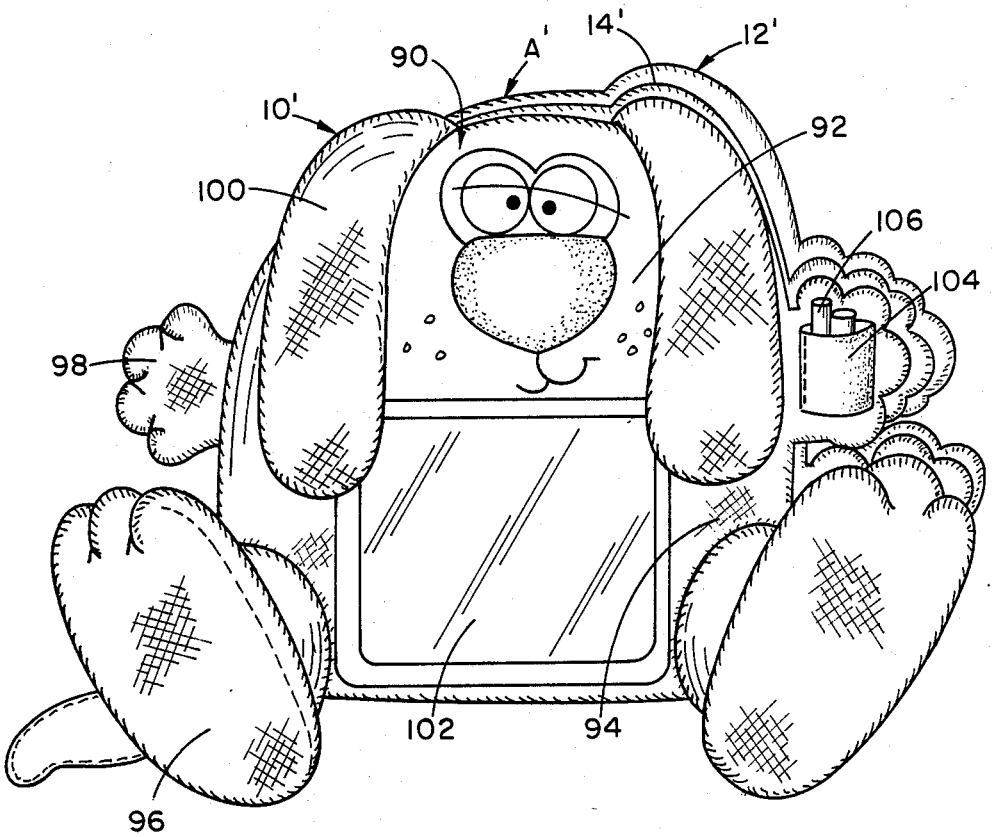
FIG. 4 is a front elevational view of a creature book according to a first alternate embodiment of the present invention.

With reference now to the first alternate embodiment of FIG. 4, the invention is there shown in a different type of creature book. For ease of illustration and appreciation of this alternative, like components are identified by like numerals with a primed (') suffix and new components are identified by new numerals.

In this embodiment, a creature book A'0 is similarly provided with a front cover 10', a back cover 12', and at least one leaf 14' held therebetween. The front cover 10' has on an outer panel thereof a creature representation 90, in the form of a rabbit, which includes a face 92, a torso, 94, legs 96, arms 98, and ears 100. Although the legs 96 and arms 98 extend away from the outer panel of the front cover, like the embodiment of FIGS. 1–4, the ears 100 do not. In this embodiment, a slate board or blackboard 102 is secured to the front cover torso 94. Also, a pocket 104 is secured to one of the arms 98 so as to hold one or more pieces of chalk 106 which can be used to write on the slate board 102. In this way, a child can not only read the book but can also write on it in a selectively erasable manner.

Figure 5:
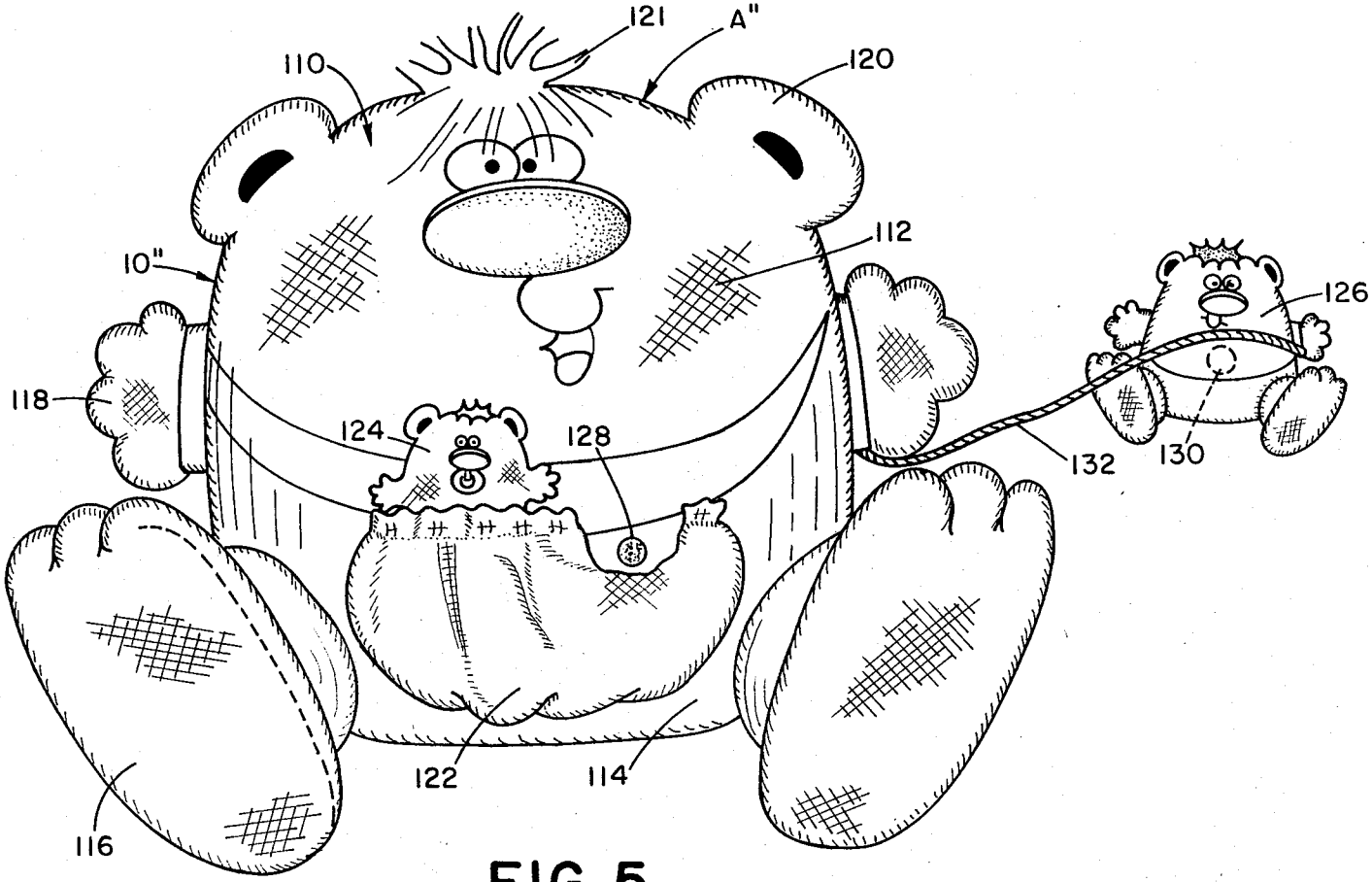
FIG. 5 is a front elevational view of a creature book according to a second alternate embodiment of the present invention.

With reference now to a second alternate embodiment of the invention illustrated in FIG. 5, the invention is there shown in yet another creature book. For ease of illustration and appreciation of this alternative, like components are identified by like numerals with a double primed (") suffix and new components are identified by new numerals.

In this embodiment, a creature book A" comprises a front cover 10", a rear cover, as well as at least one leaf held therebetween (not visible in this FIGURE). In this embodiment, a creature representation 110, in the form of a bear, is provided on the front cover and includes a face 112, a torso 114, legs 116, arms 118, and ears 120. Also, hair 121 can be provided for the creature.

A pocket 122 is provided on the torso 114 for holding a pair of smaller creatures 124, 126. In the embodiment illustrated, the creatures are small bears and the creature representation is that of a mother bear. A patch of hook and loop material 128 can be provided on the book front cover so that it can cooperate with a similar patch of hook and loop material 130 provided on a rear face of the smaller creature in order to secure the smaller creature to the creature representation. Additionally, if desired, a strap in the way of a wrist band 132 can extend between a limb of the smaller creature and a limb of the creature representation. In this way, a story written in the creature book can be acted out by a child with the help of the additional smaller creatures.

Figure 6:
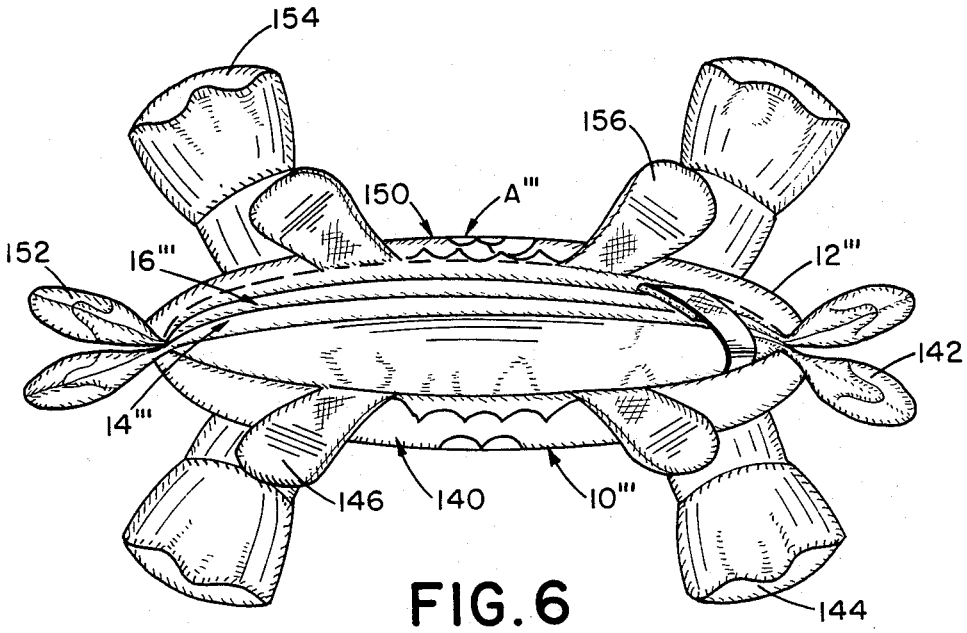
FIG. 6 is a top plan view of a creature book according to a third alternate embodiment of the present invention.

With reference now to the third alternate embodiment of FIG. 6, the invention is there shown in yet another creature book. For ease of illustration and appreciation of this alternative, like components are identified by like numerals with a triple primed (''') suffix and new components are identified by new numerals.

In FIG. 6, a creature book A''' is provided with a front cover 10''', a rear cover 12''', and a pair of leaves 14''' and 16''' held therebetween. The front cover 10''' is provided with a creature representation 140 which includes a pair of arms 142, a pair of legs 144, and a pair of ears 146. In this embodiment, the book rear cover 12''' is similarly provided with a creature representation 150. This creature representation includes a face and a torso as in the other creature representations (not visible in FIG. 7) as well as a pair of arms 152, a pair of legs 154, and a pair of ears 156. Such a two faced book may be useful for certain stories.

Figure 7:
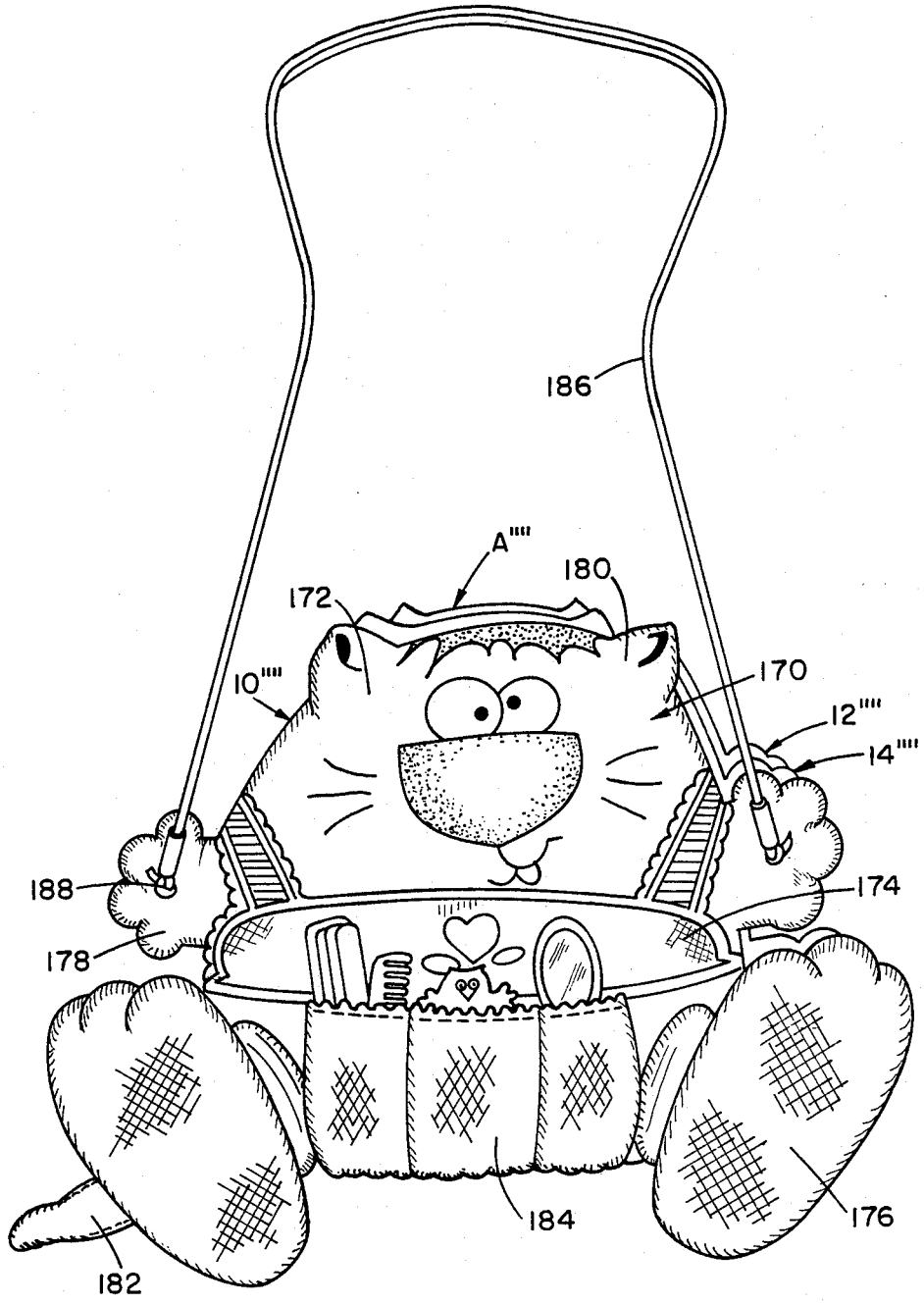
FIG. 7 is a front elevational view of the creature book according to a fourth alternate embodiment of the present invention.

With reference now to the fourth alternate embodiment of FIG. 7, the invention is there shown in yet a different creature book. For ease of illustration and appreciation of this alternative, like components are identified by like numerals with a quadruple primed (''''') suffix and new components are identified by new numerals.

In this embodiment, the creature book A'''' includes a front cover 10'''', a rear cover 12'''', and at least one leaf 14'''' held therebetween. A creature representation 170 is provided on the outer panel of the front cover 10''''. The creature representation includes a face 172, a torso 174, legs 176, arms 178, ears 180, and a tail 182. It is evident from the FIGURE that the arms, legs, and tail extend outwardly from the front panel but that in this configuration, the ears do not extend away from the front panel. In this embodiment, a plurality of pockets 184 are provided on the torso 174 for holding various items such as the illustrated comb, mirror and small toy. Additionally, a strap 186 is provided. The two ends of the strap are secured by a conventional fastener means 188 to the two arms 178 of the creature representation. This embodiment is useful as a book having a carrying case for storing several elements which can be carried on the book. Alternatively, this embodiment can be useful as a combination book and purse for a little girl.

Figure 8:
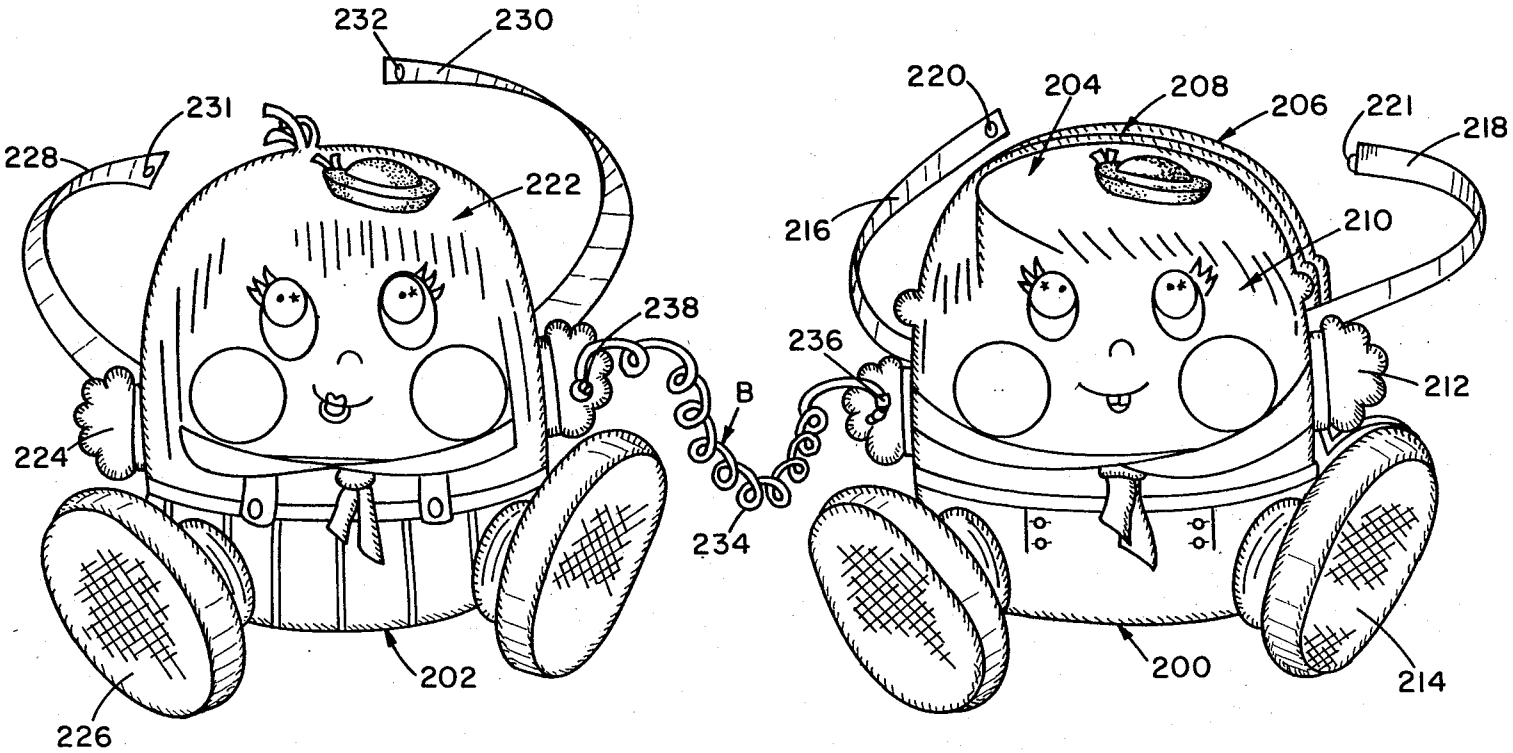
FIG. 8 is a front elevational view of a two creature combination which utilizes a creature book according to a fifth alternate embodiment of the present invention.

In a further alternate embodiment of the present invention, a creature combination B is provided as illustrated in FIG. 8. This combination includes a first creature book 200 and a second creature 202 which can be a book, if desired, although it is illustrated as just being a doll. The creature book 200 comprises a front cover 204, a back cover 206 and at least one leaf 208 therebetween. A creature representation 210 is provided on the front cover 204 with the creature having outwardly extending arms 212 and legs 214. A first strap 216 and a second strap 218 extend from opposed sides of the creature book 200. A suitable fastener means including elements 220, 221 is provided on the free ends of the two straps 216, 218 for securing the straps together.

The second creature 202 similarly has provided on an outer face thereof a creature representation 222 including arms 224 and legs 226. Also, a pair of straps 228, 230 are provided. A suitable fastener means including elements 231, 232 is provided for securing the two straps together. A connecting strap 234 extends between the creature book 200 and the second creature 202. The strap 234 is secured by a suitable conventional fastener means 236 on a first end to an appendage of the creature representation 210 and on a second end by a suitable fastener means 238 to an appendage of the second creature 202. This embodiment of the invention can be useful as a combination book and connecting band for a child and a grown-up with at least one of the bodies 200, 202 being a book that contains a story therein. The first and second creatures 200, 202 can be secured around the wrists of the wearer, or, if the bodies 200, 202 are large enough, can be worn at the waist to connect two people together. It would also be conceivable to detach the strap 234 and just wear one of the creatures.

Figure 9:
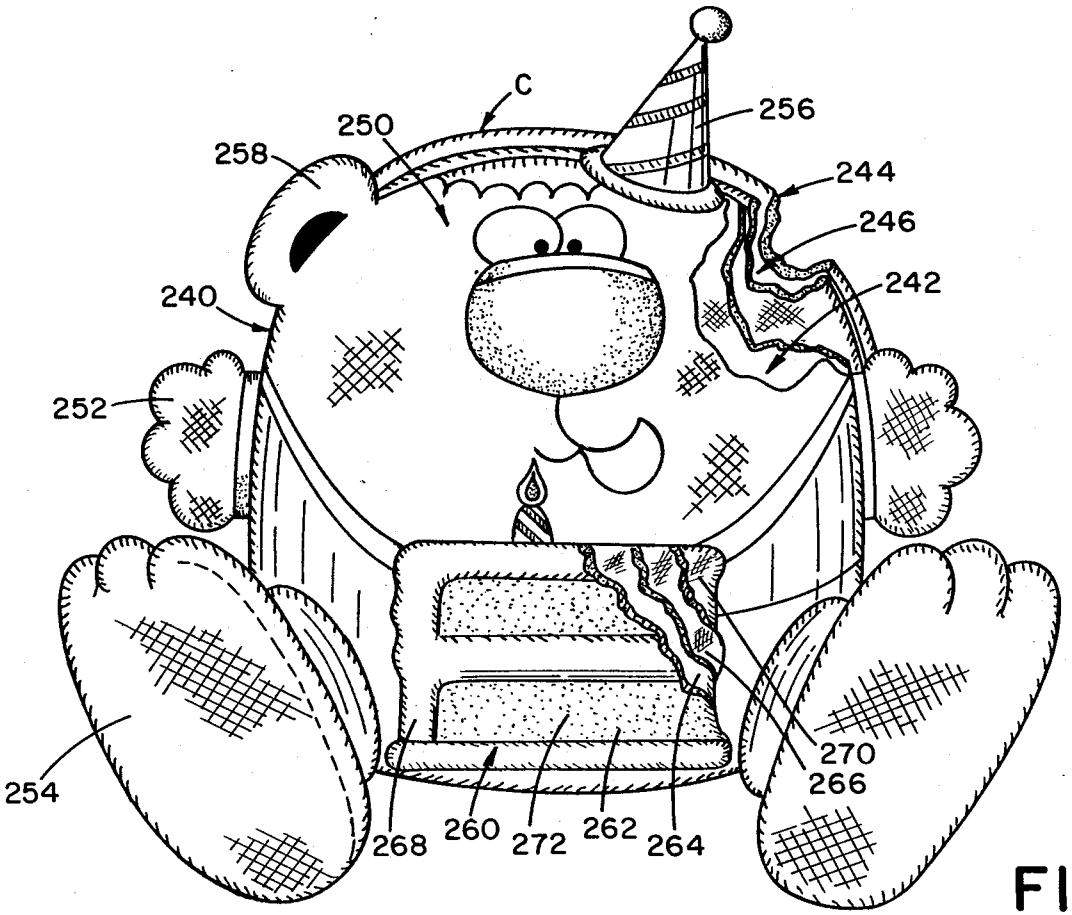
FIG. 9 is a front elevational view, partially broken away, of a double book according to a sixth alternate embodiment of the present invention; and, FIG. 10 is a front elevational view of the creature book of FIG. 1 showing the book in an open position to illustrate written indicia on one page of the book and a picture on an opposing page of the book.

Finally, the present invention can be embodied in a double book C as is illustrated in FIG. 9. In this FIGURE, the double book includes a larger book 240 having a front cover 242, a back cover 244, and one leaf 246 positioned therebetween. A creature representation 250 is provided on the front cover with the creature having arms 252, legs 254, a hat 256, and ears 258. As in the other embodiments, the four limbs of the creature extend past the periphery of the book pages. In this embodiment, the hat 256 also extends therepast as do the ears 258.

A smaller book 260 is secured to a front panel of the front cover at a torso of the creature representation. The smaller book has a front cover 262 and is illustrated as having two leaves 264, 266. A binding 268, positioned along one side edge of the front cover of the leaves, enables the several pages of the smaller book to be secured together so that the book can be opened along the opposing side edge thereof. A rear page 270 of the smaller book is secured to the torso of the creature representation 250. Additionally, a suitable object 272 can be represented on the front cover of the small book. In the embodiment illustrated, the creature book is a birthday book and the second smaller book front cover illustrates a birthday cake. The smaller book can be written in by the child or the parent to detail the child's birthday date, height, weight, and other vital statistics. Other pages of the smaller book can be used to list some of the child's favorite things or hold photos of the child, or the like.

The invention has been described with reference to numerous preferred and alternate embodiments. Obviously, modifications and alterations will occur to others upon a reading and understanding of this specification. It is intended to include all such modifications and alterations insofar as they come within the scope of the appended claims or the equivalents thereof.

Having thus described the preferred and alternate embodiments, the invention is now claimed to be:

1. A creature book, comprising:

at least one leaf comprising two superposed panels of material in the form of an envelope, the two panels being secured together around their periphery;

a back cover;

a front cover, comprising:

inner and outer superposed panels of material which are secured together around their periphery in the form of an envelope;

a layer of padding material held between said inner and outer panels, a creature representation provided on said outer panel, said creature representation including four limbs which extend away from said outer panel such that two opposed upper limbs extend outwardly past said periphery of said inner and outer panels and two lower limbs are secured to and extend outwardly from said outer panel in an orientation generally normal thereto wherein, said two lower limbs are located adjacent an end edge of said front cover, and are disposed generally normal to said front cover for allowing the creature book to rest in an orientation substantially normal to a support surface without toppling over even when the creature book is closed; and a binding means for securing together an edge of said front and back covers and an edge of each of said plurality of leaves.

2. The creature book of claim 1 wherein said at least one leaf has written indicia provided thereon.

3. The creature book of claim 1 further comprising a means for releasably securing said front and back covers together along an edge opposed to the edge along which said binding means is disposed.

4. The creature book of claim 1 wherein said front cover further comprises at least one pocket provided on said outer panel, said at least one pocket being adapted for holding an object.

5. The creature book of claim 4 further comprising a strap secured to two of said limbs of said creature representation.

6. The creature book of claim 1 wherein said rear cover comprises:

inner and outer superposed panels of material which are secured together around their periphery in the form of an envelope;

a layer of padding material held between said inner and outer panels; and, a creature representation provided on said outer panel, said creature representation including a plurality of limbs wherein at least two of said limbs extend outwardly from said outer panel.

7. The creature book of claim 1 further comprising a smaller second book including at least two pages, said second book being secured to said front cover.

8. The creature book of claim 1 further comprising:

a first body strap secured to one of said front and back covers;

a second creature including a plurality of limbs;

a second body strap secured to said second creature; and, a connecting strap secured at a first end to a limb of said creature representation and secured at a second end to a limb of said second creature.

9. The creature book of claim 1 wherein each of said four limbs comprises:

an outer cover;

a padding material held in said outer cover so as to form a three-dimensional body; and, an attaching means for securing said limb outer cover to said book front cover.

10. A creature book comprising:

a back cover comprising inner and outer superposed panels of material which are fastened to each other, said panels having coextensive peripheries;

a front cover comprising:

inner and outer superposed panels of material which are fastened to each other, said panels having coextensive peripheries;

a layer of a soft material held between said inner and outer panels, a creature representation provided on said outer panel, said creature representation including a plurality of limbs, wherein at least two of said limbs extend outwardly away from said coextensive peripheries of said inner and outer panels, wherein said at least two limbs are located adjacent one end edge of said front cover, each of said limbs comprising:

an outer cover, a padding material held in said outer cover so as to form a three dimensional body, and an attaching means for securing said limb outer cover to said book front cover, and wherein said limbs are oriented approximately normal to said front cover which allows the creature book to rest in an orientation substantially normal to a support surface;

indicia provided on at least one of said inner and outer superposed panels of said front and back covers; and, a binding means disposed along an edge of each of said front and back covers for securing them together.

11. The creature book of claim 10 further comprising at least one leaf disposed between said front and back covers, said at least one leaf being secured along an edge to said front and back covers by said binding means.

12. The creature book of claim 10 further comprising a means for releasably securing said front and back covers together along an edge opposed to said edge along which said binding means is disposed.

13. The creature book of claim 12 wherein said means for releasably securing comprises hook and loop fastener strips including cooperating strip sections provided on said front and back covers.

14. The creature book of claim 10 wherein said front cover further comprises at least one pocket means provided on said outer panel for holding an object.

15. The creature book of claim 10 further comprising a smaller second book including at least two pages, said second book being secured to said front cover.

16. The creature book of claim 10 wherein said front cover further comprises a patch of hook and loop material and further comprising a relatively small creature which can be selectively secured to said book front cover, said smaller creature having a patch of hook and loop material which is adapted to cooperate with said patch of hook and loop material of said book front cover.

17. The creature book of claim 10 further comprising:

a relatively small creature having limbs; and, a connecting strap secured at a first end to a limb of said relatively small creature and at a second end to a limb of said creature representation on said book front cover.

18. The creature book of claim 10 further comprising:

a first body strap secured at each of its ends to one of said front and back covers;

a second creature including a plurality of limbs;

a second body strap secured at each of its ends to said second creature; and, a connecting strap secured at a first end to a limb of said creature representation on said front cover and secured at a second end to a limb of said second creature.

19. The creature book of claim 10 wherein said rear cover further comprises:

a layer of soft material which is held between said inner and outer panels; and, a creature representation provided on said outer panel, said creature representation including a plurality of limbs wherein at least two of said limbs extend outwardly from said outer panel of said rear cover.

* * * * *